US007140851B2

(12) United States Patent
Tarng

(10) Patent No.: US 7,140,851 B2
(45) Date of Patent: Nov. 28, 2006

(54) AXIAL COMPLIANCE MECHANISM OF SCROLL COMPRESSOR

(75) Inventor: Guang-Der Tarng, Sijhih (TW)

(73) Assignee: Chyn Tec. International Co., Ltd., Taipei County (TW)

( * ) Notice: Subject to any disclaimer, the term of this patent is extended or adjusted under 35 U.S.C. 154(b) by 81 days.

(21) Appl. No.: 10/934,483

(22) Filed: Sep. 7, 2004

(65) Prior Publication Data

US 2006/0051227 A1 Mar. 9, 2006

(51) Int. Cl.
*F03C 2/00* (2006.01)
*F04C 18/00* (2006.01)

(52) U.S. Cl. ..... 418/55.5; 418/55.1; 418/57

(58) Field of Classification Search ..... 418/55.5, 418/57, 55.1, 55.2
See application file for complete search history.

(56) References Cited

U.S. PATENT DOCUMENTS 4,314,796 A * 2/1982 Terauchi ..... 418/57
4,940,396 A * 7/1990 Shimizu et al. ..... 418/55.1
5,256,044 A 10/1993 Nieter et al.
5,257,920 A * 11/1993 Takeda ..... 418/55.1
6,287,097 B1 * 9/2001 Takeuchi et al. ..... 418/55.5
6,379,131 B1 * 4/2002 Hoashi ..... 418/55.1
6,416,301 B1 * 7/2002 Bush et al. ..... 418/55.5

FOREIGN PATENT DOCUMENTS

JP 06081781 A * 3/1994
JP 06173864 A * 6/1994
TW 263024 11/1995

* cited by examiner

*Primary Examiner*—Theresa Trieu

(57) ABSTRACT

An axial compliance mechanism of a scroll compressor is installed between a compressor housing and a scroll. The housing has a first shell and a second shell. The first shell defines a chamber and has a guiding part at one end of and in communication with the interior of the chamber. The scroll has a fixed scroll member and an orbiting scroll member. A plurality of compression pockets is formed between these two scroll members. A rear surface of the fixed scroll member has a protrusion matching the guiding part of the first shell and a venting hole in communication with the compression chambers. A sealing device is installed between the guiding part and the protrusion, and a negative pressure chamber is formed. Thereby, the working fluid is guided into the negative pressure chamber during operation, so as to provide a tight attachment between the fixed scroll member and the orbiting scroll member, such that the volume efficiency of the compressor is enhanced.

11 Claims, 6 Drawing Sheets

AXIAL COMPLIANCE MECHANISM OF SCROLL COMPRESSOR

BACKGROUND OF THE INVENTION

The present invention relates in general to an axial compliance mechanism of a scroll compressor, and more particularly, to a structure for improving axial sealing compliance of a scroll.

A typical scroll compressor includes two scroll members, namely, a fixed scroll and an orbiting scroll. The orbiting scroll revolves about the fixed scroll. In compression operation, the fixed scroll and the orbiting scroll each has an involute wrap inter-fitting each other to allow working fluid entering a compression chamber through a suction port thereof. The continuous revolutions of the orbiting scroll further provide compression of the working fluid until the working fluid is discharged from an inner discharge port of the fixed scroll to complete the compression process of the working fluid. During the compression operation, the volume of the working fluid is reduced, while the pressure thereof is increased. Thereby, axial force, radial force and tangential force are created. The axial force tends to cause axial separation of these two scroll members. The radial and tangential forces generate biasing torques. The axial, radial and tangential forces cause leakage from the end panels or the side surfaces of the wraps. How to enhance the volume efficiency of the compressor has thus become an important topic in this field.

In U.S. Pat. No. 5,256,044, the pressurized working fluid is guided at the back surface of the orbiting scroll member to closely attach the orbiting scroll member to the fixed scroll member, so as to achieve an axial sealing effect. However, as the orbiting scroll member has to overcome the axial force and the biasing torques, an excessive pressure is typically resulted to cause unwanted frictional damage. The lifetime of the compressor is thus greatly reduced.

In the Taiwanese Patent No. 263024, a compressor having a top shell, bottom shell, a fixed scroll, a orbiting scroll and a spacer is disclosed. Each of the top and bottom shells has a cavity. The top shell has a venting hole formed on one side thereof. The top shell is soldered or welded on top of the bottom shell. The bottom shell includes the fixed scroll and the orbiting scroll each having an involute wrap inter-fitting each other. The top surface of the fixed scroll includes a protruding tubular neck. A spacer is firmly installed in the top shell. The center of the spacer is opened with a hole allowing the tubular neck of the fixed scroll to extend through. A plurality of through holes is formed at an adequate distance to the hole of the spacer. The through holes provide connections of various pressure supply devices. Thereby, an axial compliance mechanism of a scroll compressor is formed.

However, as the spacer is fixed in the top shell, and the fixed and orbiting scrolls are fixed in the bottom shell, lateral force and deformation are inevitable during the welding process. As the concentric requirement between the hole of the spacer, the tubular neck of the fixed scroll and the rotation part of the motor is rather high, the yield is typically low. Further, to stably maintain the pressure balance of the spacer, the pressure supply devices and related members have to be spaced by 120° with each other. When many devices are required by the compressor, this greatly increases material and fabrication cost. In addition, when the working fluid is discharged from the venting port of the top shell, the pressure applied to the pressurizing members is uneven to cause unbalance by the fixed scroll, such that high noise and friction between devices are generated.

BRIEF SUMMARY OF THE INVENTION

The present invention provides an axial compliance mechanism of a scroll compressor. A negative pressure chamber is formed between a first shell and a fixed scroll. In compression operation, the working fluid is guided into the negative pressure chamber to force the fixed scroll closely attach to the orbiting scroll, so as to enhance the volume efficiency of the compressor.

The axial compliance as provided does not require a spacer, such that the overall structure is simplified, and the compressor is easily assemble. The deformation and alignment problem caused by welding process is resolved. Therefore, the assembly yield is greatly improved.

In one embodiment, the axial compliance mechanism is installed between the compressor housing and the scroll device. The housing includes a first shell and a second shell. The first shell has a chamber and a guiding part formed at the end of the chamber in communication with the chamber. The scroll device includes a fixed scroll and an orbiting scroll. A plurality of compression pockets are formed between the fixed and orbiting scrolls. The fixed scroll includes a protrusion on a rear surface thereof. The protrusion matches the guiding part of the first shell. The first shell also has a venting hole for the compression chamber. A sealing device and a negative pressure chamber are formed between the guiding part and the protrusion.

BRIEF DESCRIPTION OF THE DRAWINGS

The above objects and advantages of the present invention will be become more apparent by describing in detail exemplary embodiments thereof with reference to the attached drawings in which.

And

Figure 6:
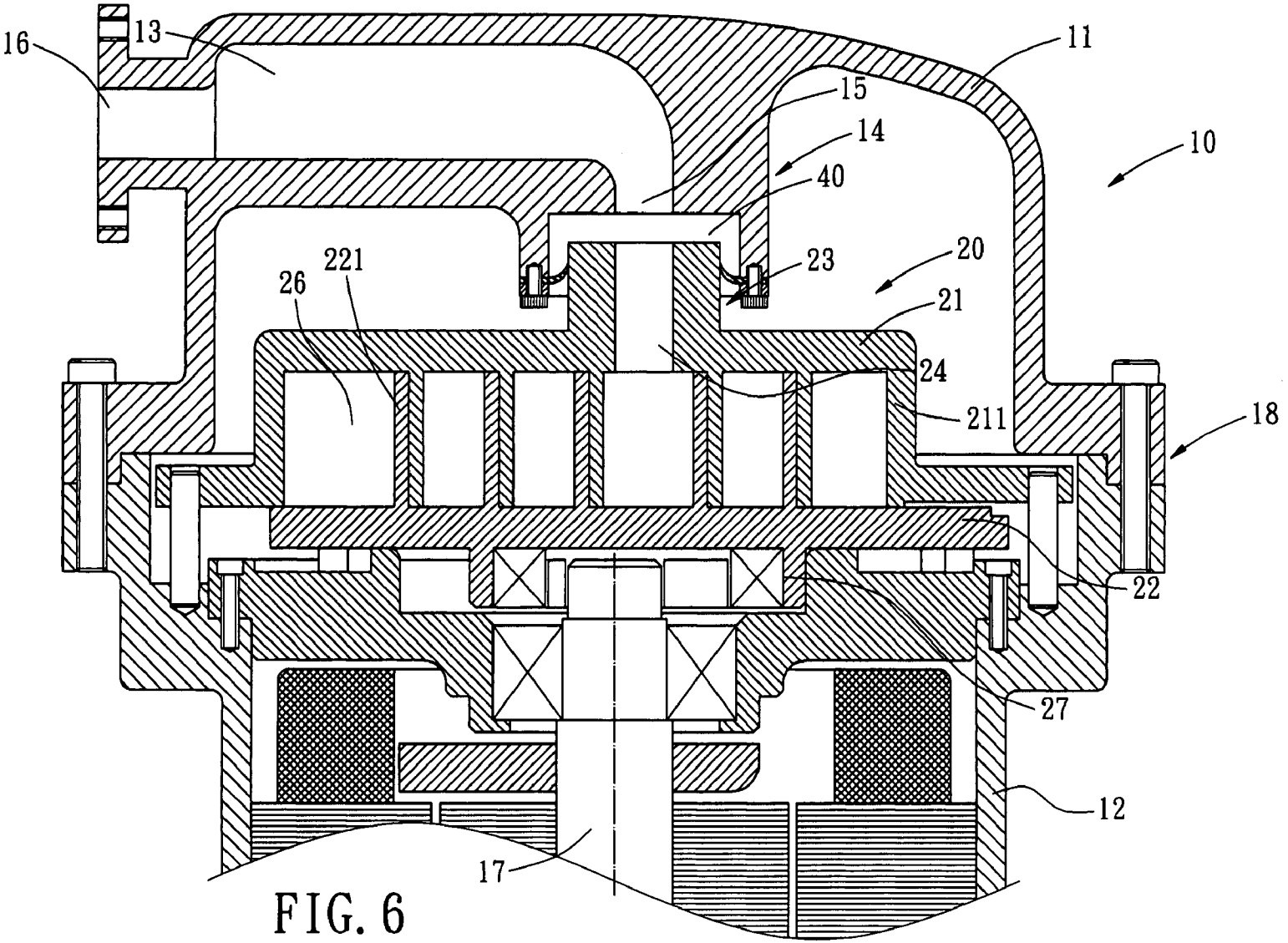

FIG. 6 is a cross sectional view of a sixth embodiment of a scroll compressor.

DETAILED DESCRIPTION OF THE INVENTION

Figure 1:
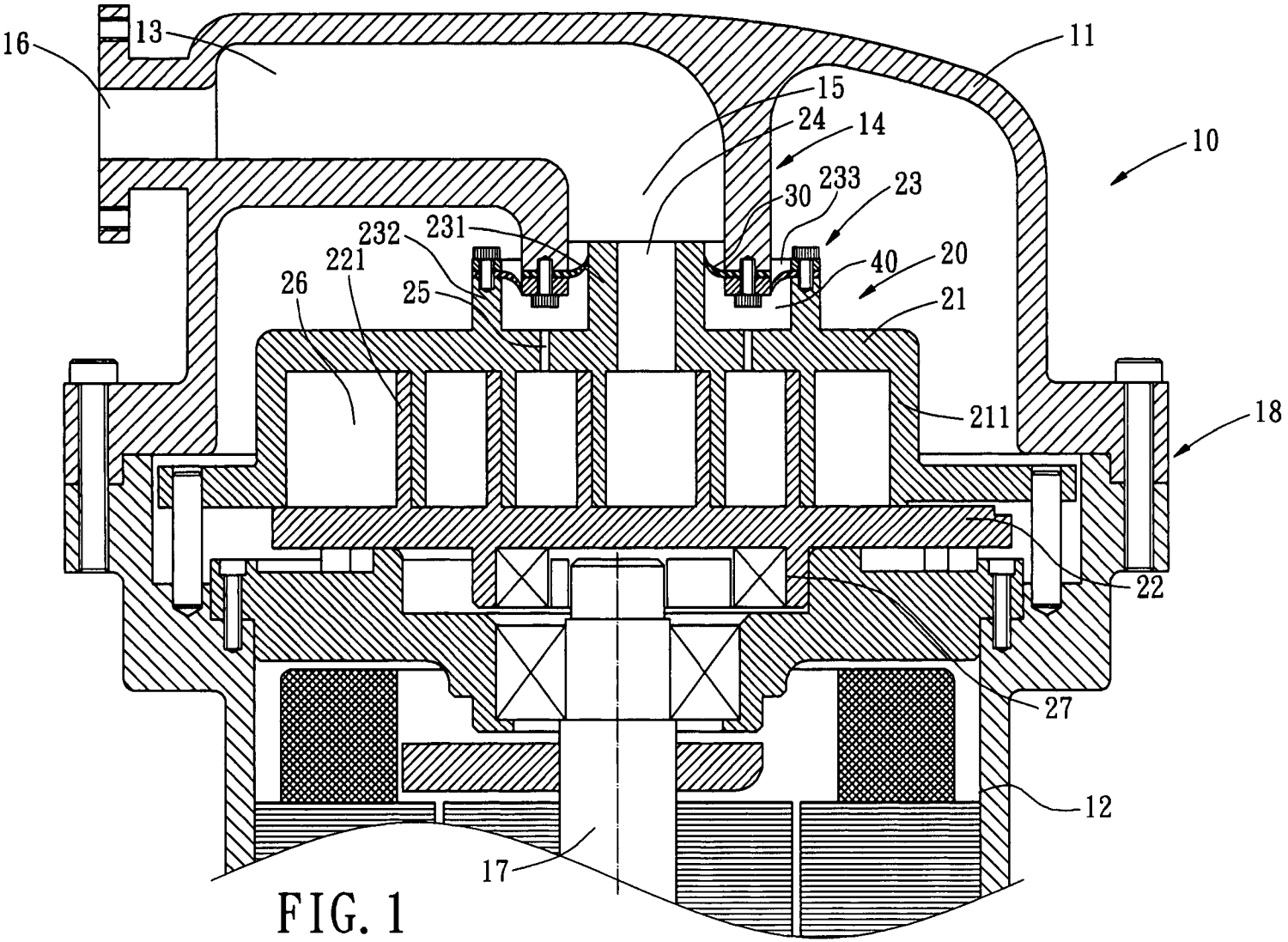
FIG. 1 is a cross sectional view of a first embodiment of a scroll compressor.

Referring to FIG. 1, a cross sectional view of a first embodiment of an axial compliance mechanism for a scroll compressor is shown. As shown, the scroll compressor comprises a housing 10 and a scroll device 20, and the axial compliance mechanism is installed between the housing 10 and the scroll device 20.

The housing 10 has a first shell 11 and a second shell 12. Each of the shells 11 and 12 has a hollow chamber. Fastening members such as screws or welding or soldering process can be used to attach the first shell 11 on top of the second shell 12. The first shell 11 has a closed receiving chamber 13. Extending from one end of the closed receiving chamber 13 includes a guiding part 14. The guiding part 14 is preferably in the form of a cylinder. The bottom of the closed receiving chamber 13 has a hole 15, while the other end of the closed receiving chamber 13 has a exhausting hole 16. The second shell 12 has an inlet port (not shown) allowing the working fluid to flow therein. Various compressor devices, actuation mechanism and motor are installed in the second shell 12. The motor includes an actuation axis 17 extending axially.

The scroll device 20 is installed in the housing 10, including a fixed scroll 21 and an orbiting scroll 22. An involute wrap 211 is formed at the lower part of the fixed scroll 21, while a protrusion 23 protrudes from a top portion of the fixed scroll 21. The protrusion 23 includes an annular member 231 and a second annular member 232. An annular slot 233 is formed between the first and second annular members 231 and 232. The protrusion 23 matches the guiding part 14 of the first shell 11, such that the guiding part 14 can extend into the slot 233 of the protrusion 23 with the first annular member 231 disposed into the hole 15 of the guiding part 14. At least a venting hole 24 is formed in the center of the protrusion 23. Preferably, the venting hole 24 is aligned with the hole 15 of the guiding part 14. Through holes 25 are also formed in the top surface of the fixed scroll 24 at two sides of the hole 15 and the venting hole 24. The orbiting scroll 22 also has an involute wrap 221 inter-fitting the involute wrap 211 of the fixed scroll 21. Multiple compression pockets 26 are formed between the fixed scroll 21 and the orbiting scroll 22. An axial aperture 27 is formed under the orbiting scroll 22 allowing a bearing and bushing extending through. The bushing allows provide the connection to the actuation axis 17 of the motor.

At least a sealing device 30 is installed between the guiding part 14 and the protrusion 23. The sealing device 30 includes a lip seal, O-ring, U-shape sealing loop, mechanical seal or other types of sealing devices. In this embodiment, a lip seal is in use. The sealing device 30 is attached to the end surface of the guiding part 14 and secured by fixing ring and screw. The other side of the sealing device is attached along a periphery of the first annular member 231 of the protrusion 23. Another sealing device 30 has one side fixed to the end surface of the second 20 annular member 232 and the other side attached to an exterior periphery of the guiding part 14. Thereby, a negative pressure chamber 40 is formed between the guiding part 14, the protrusion 23 and the sealing device 30. The negative pressure chamber 40 is in communication with the compression pockets 26 through the through holes 25, so as to guide medium- or high-pressure working fluid therein. Thereby, a medium- or high-negative pressure chamber is formed.

By the above assembly, when the orbiting scroll 22 is driven to revolve by the actuation axis 17, low-pressure working fluid is absorbed through the suction port of the second shell 12 to enter the compression pockets 26 formed by the wraps 211 and 221 of the fixed and orbiting scrolls 21 and 22. The revolution of the orbiting scroll 22 causes the working fluid to move from a periphery of the scroll device 20 towards the center thereof. The volume of the working fluid is gradually reduced, while the pressure thereof increases from low to medium. Further compression towards high pressure will then discharge the working fluid out of the compression pockets 26 from the venting hole 24 of the fixed scroll 21. In this embodiment, through holes 25 are formed on the fixed scroll 21 to guide the medium-pressure working fluid into the negative pressure chamber 40, so as to form a medium-pressure chamber which pushes the fixed scroll 21 downwardly to closely attach the orbiting scroll 22, so as to achieve the sealing effect.

To resolve the problems of lateral force and deformation caused by welding process between the first and second shells 11 and 12, a positioning part 18 is formed at the joint of the first and second shells 11 and 12. In this embodiment, the positioning part 18 includes an exterior ring formed at the end surface of the first shell 11 and an interior ring formed at the end surface of the second shell 12. Other devices such as a positioning pin and hole may also be formed at the end surfaces of the first and second shells 11 and 12 to achieve the positioning effect.

Figure 2:
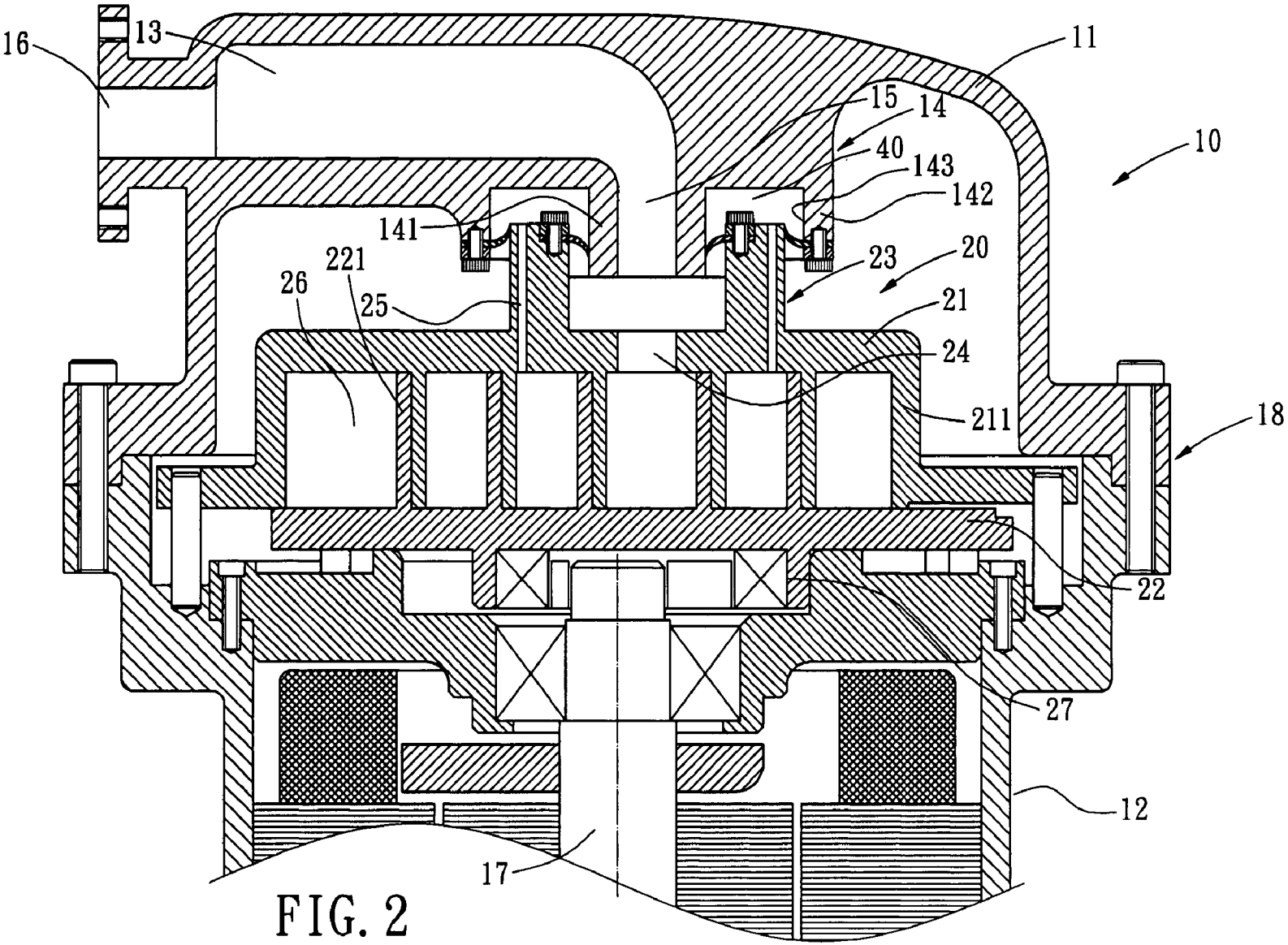
FIG. 2 is a cross sectional view of a second embodiment of a scroll compressor.

FIG. 2 shows that the guiding part 14 is formed of a first ring 141 and a second ring 142. An annular slot 143 is formed between the first and second rings 141 and 142. The protrusion 23 is in the form of a cylindrical axis received within the annular slot 143. The sealing device 30 is attached to the second ring 142 and the internal end surface of the protrusion 23.

Figure 3:
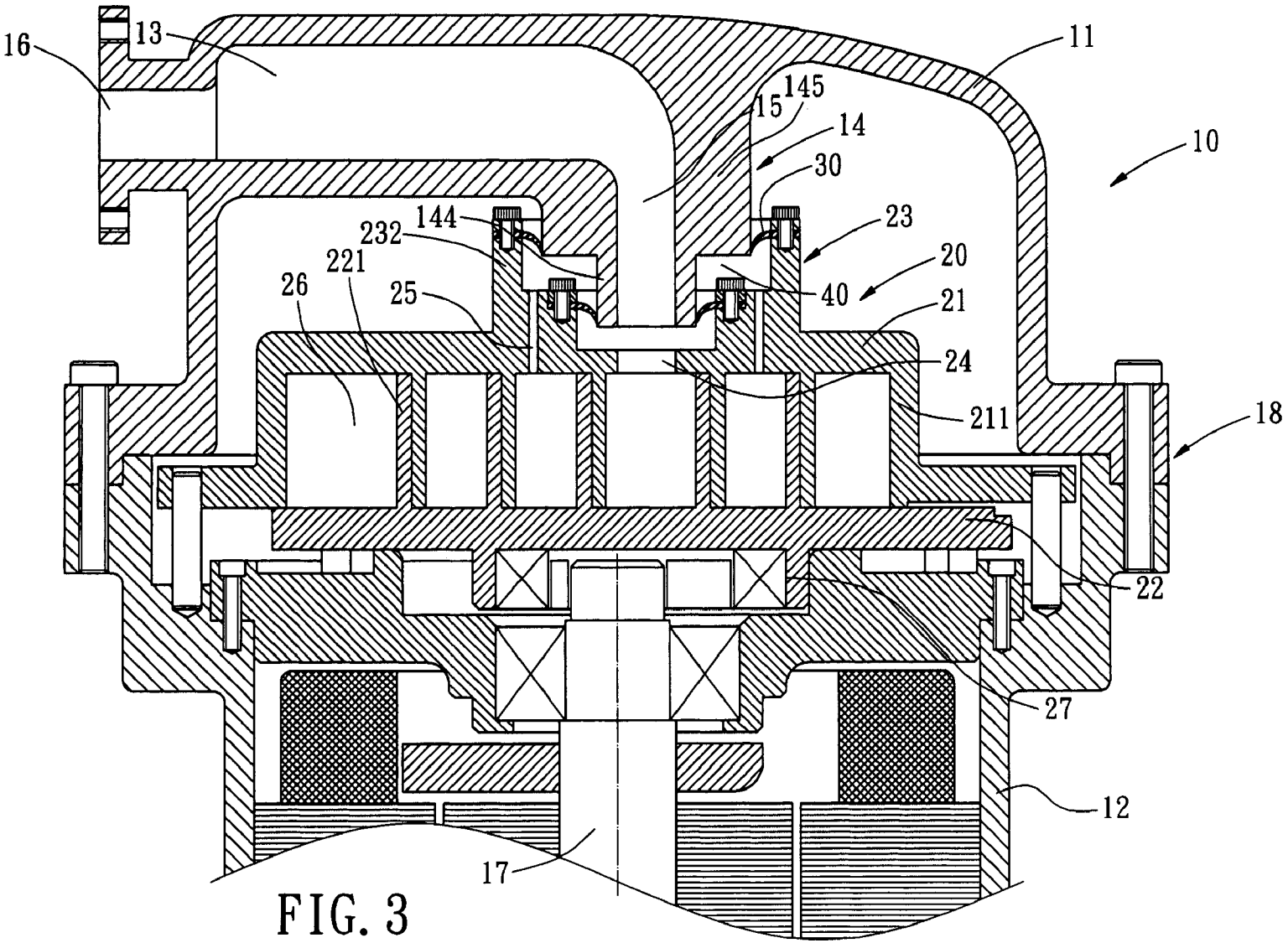
FIG. 3 is a cross sectional view of a third embodiment of a scroll compressor.
Figure 4:
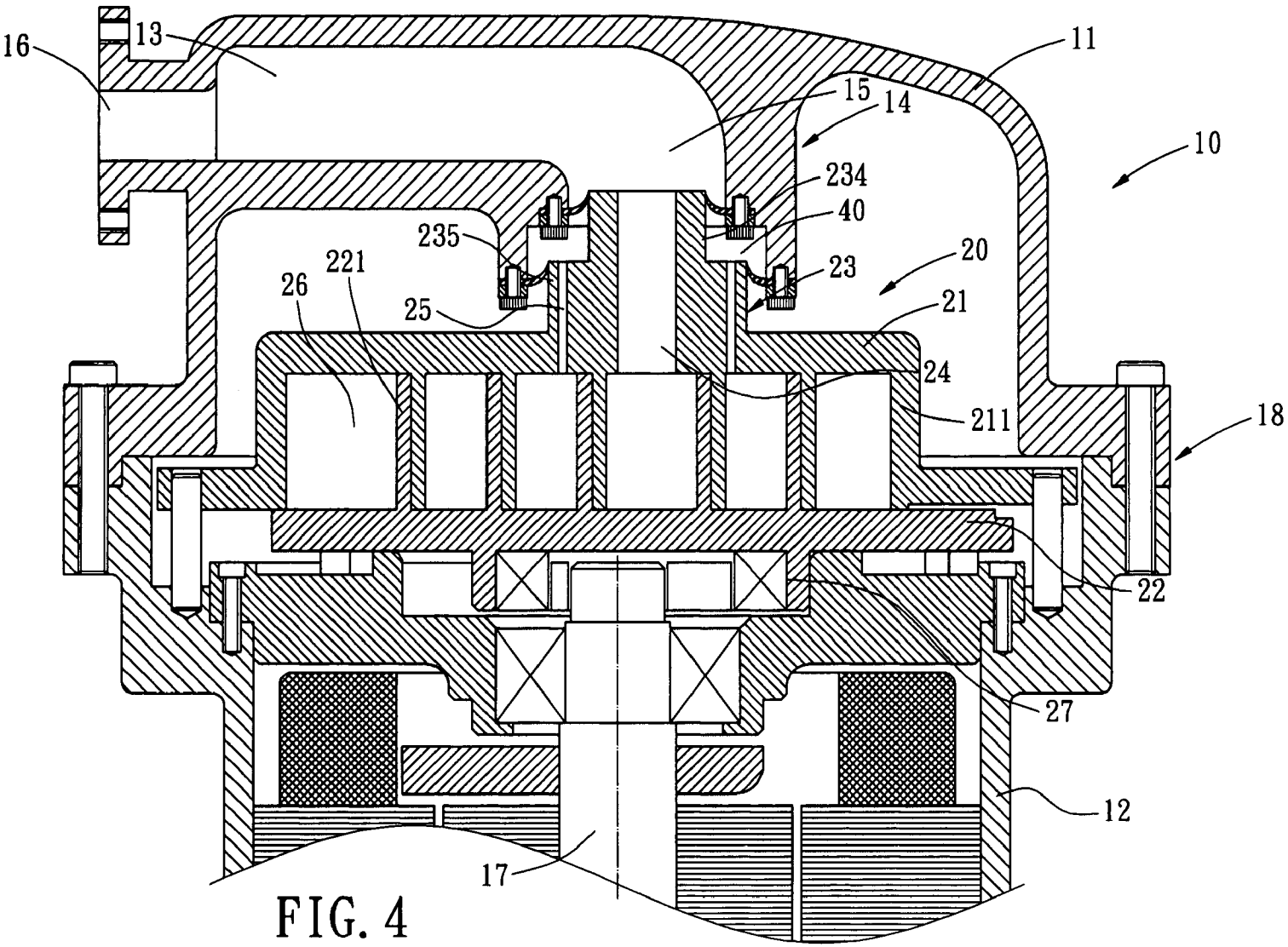
FIG. 4 is a cross sectional view of a fourth embodiment of a scroll compressor.

Referring to FIGS. 3 and 4, a third embodiment and a fourth embodiment are illustrated, respectively. In the third embodiment, the guiding part 14 that includes a first cylinder 144 and a second cylinder 145 is received within the protrusion 23. The internal surface of the protrusion 23 includes a step-like cylindrical axis that receives the first and second cylinders 144 and 145. The sealing device 30 is installed at the internal and external end surfaces of the protrusion. The fourth embodiment is an inverse of the third embodiment. That is, the protrusion 23 is received within the guiding part 14, while the sealing device 30 is installed at the internal and external end surfaces of the guiding part 14.

Figure 5:
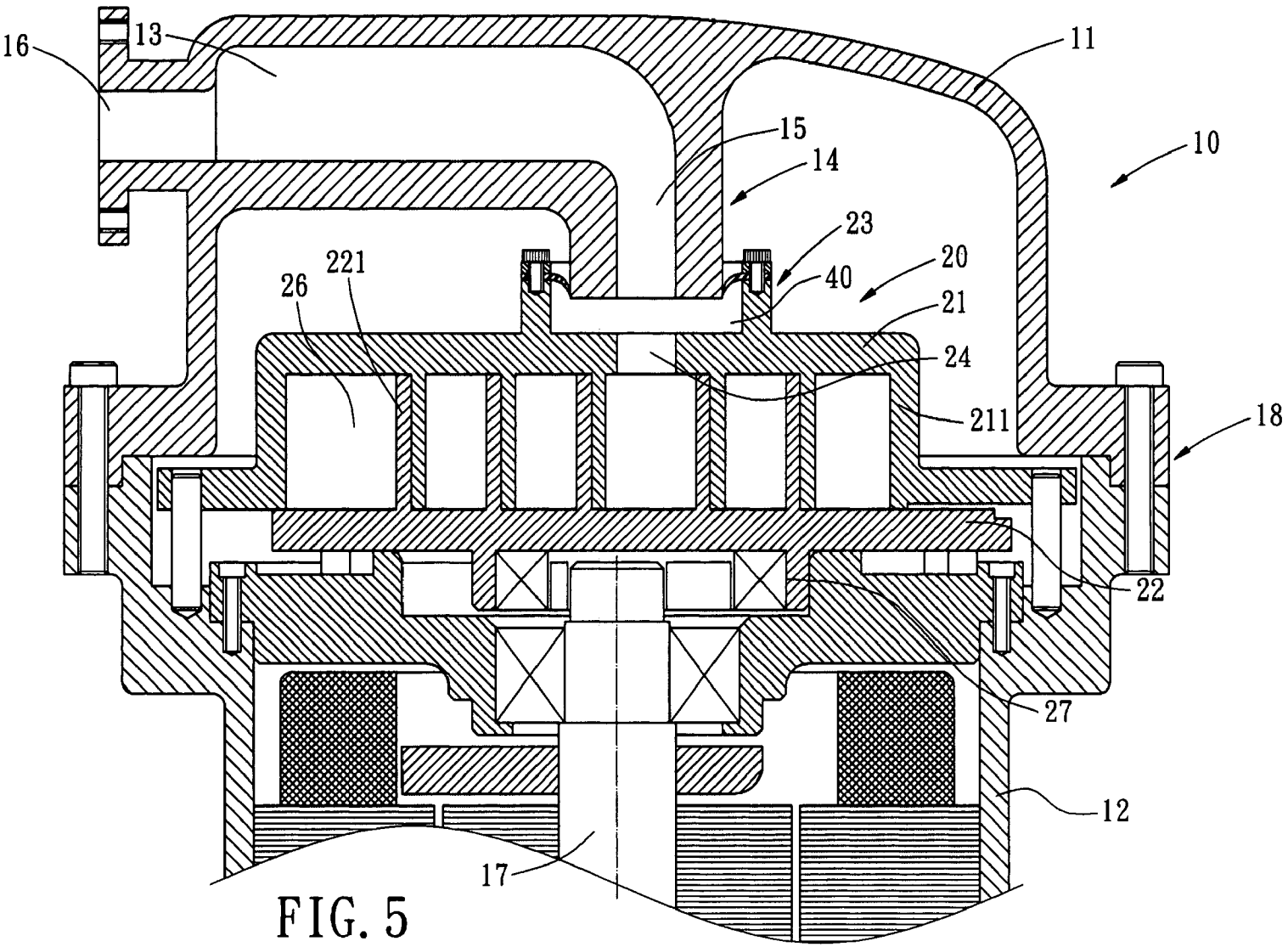
FIG. 5 is a cross sectional view of a fifth embodiment of a scroll compressor.

FIGS. 5 and 6 shows the fifth and sixth embodiments of the guiding part 14 and the protrusion 23. In the fifth embodiment, the guiding part 14 is received within the protrusion 23, while the sealing device 30 is installed on an end surface of the protrusion 23, such that high-pressure working fluid is formed within the negative pressure chamber 40. A downward axial pressure is thus created by the high-pressure working fluid to push the fixed scroll 21 towards the orbiting scroll 22. Thereby, the fixed and orbiting scrolls 21 and 22 are closely attached to each other to achieve the sealing effect between the fixed and orbiting scrolls 21 and 22. Similarly, in the sixth embodiment, the protrusion 23 is received within the guiding part 14, while the sealing device 30 is fixed on an end surface of the guiding part 14 to create a high-negative-pressure effect.

Therefore, the axial compliance mechanism of a scroll compressor as provided has at least the following advantages. Firstly, the medium- or high-pressure working fluid is guided into the negative pressure chamber to force the fixed scroll moving downwardly and axial, such that the axial force and biasing torque applied to the fixed scroll during compression operation is overcome. As a result, the axial gap between the fixed scroll and the orbiting scroll is minimized to prevent the working fluid from leaking from the end surface of the compression chamber, so as to enhance the volume efficiency of the compressor. Further, the spacers, compressing members and other devices are not required to simplify the overall structure of the compressor. Therefore, the scroll compressor is more easily to assemble. The problems of deformation and alignment caused by welding process are resolved to greatly increase the assembly yield.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. An axial compliance mechanism of a scroll compressor installed between a compressor housing and a scroll device, comprising:

a first shell and a second shell to form the housing, the first shell having a receiving chamber and a guiding part in communication with the receiving chamber;

a fixed scroll;

an orbiting scroll; and a plurality of compression pockets between the fixed and the orbiting scrolls, wherein the fixed scroll has a protrusion extending from a rear surface thereof to match the guiding part of the first shell, and a sealing device between the guiding part and the protrusion to form a negative pressure chamber, and wherein the guiding part includes a first ring, a second ring and an annular slot, the protrusion is in the form of a cylindrical shell received within the annular slot, and the sealing device is installed at the second ring and the cylindrical shell.

2. The mechanism of claim 1, wherein the first shell and the second shell are connected to each other by screw members or welding process.

3. The mechanism of claim 1, wherein the guiding part is integrally formed with the first shell.

4. The mechanism of claim 1, wherein the guiding part is in the form of a cylindrical shell, the protrusion includes a first ring, a second ring and an annular slot formed between the first and second rings allowing the guiding part received therein, and the sealing device is mounted to the second ring and the cylindrical shell.

5. The mechanism of claim 1, wherein the guiding part includes a first cylindrical shell and a second cylindrical shell, the protrusion includes a cylindrical axis having a stair-like interior surface, such that the first and the second cylindrical shells is received within the protrusion, and the sealing device is attached to an internal surface and an external surface of the protrusion.

6. The mechanism of claim 1, wherein the guiding part includes a cylindrical shell having a stair-like internal surface, the protrusion includes a first cylindrical shell and a second cylindrical shell received in the guiding part, and the sealing device is mounted to the internal and external surface of the guiding part.

7. The mechanism of claim 1, wherein the fixed scroll includes a venting hole in communication with the receiving chamber and the negative pressure chamber.

8. The mechanism of claim 1, wherein the protrusion and the guiding parts are in the forms of cylinders, the guiding part is received within the protrusion, and the sealing device is mounted to an end surface of the protrusion.

9. The mechanism of claim 1, wherein the guiding part and the protrusion are in the forms of cylinders, the protrusion is installed in the guiding part, and the sealing device is attached to an end surface of the guiding part.

10. The mechanism of claim 1, wherein the negative pressure chamber includes a medium-pressure negative chamber.

11. The mechanism of claim 1, wherein the sealing device includes a lip, an O-ring, a U-shape sealing loop or a mechanical bushing.

* * * * *